US006113521A

United States Patent [19]

Winston

[11] Patent Number: 6,113,521

[45] Date of Patent: Sep. 5, 2000

[54] CONSTRUCTION FOR EXERCISE WEIGHT COMPARTMENTS

[76] Inventor: Edith Winston, 2110 Habourside Dr. #528, Longboat Key, Fla. 34228

[21] Appl. No.: 09/307,017

[22] Filed: May 7, 1999

[51] Int. Cl.[7] ..... A63B 21/065

[52] U.S. Cl. ..... 482/105; 482/119; 482/50; 482/45

[58] Field of Search ..... 482/105, 50, 45, 482/119, 148, 98; 441/88; 182/3; 2/311, 318–326; 405/186; 128/869, 876

[56] References Cited

U.S. PATENT DOCUMENTS 3,525,141 8/1970 Smith ..... 29/400

*Primary Examiner*—Michael A. Brown
*Assistant Examiner*—Lori Baker Amerson
*Attorney, Agent, or Firm*—Myron Amer, P.C.

[57] ABSTRACT

An exercise belt with compartments for individual exercise bar weights, which is sometimes used with some empty compartments to reduce the exercising effort, the use of elastomeric construction material for each compartment holding by its urgency the bar weights in place, rather than the use of a closure flap over all of the openings of all of the compartments even those that are empty, and being empty are not effective in providing an interengaged loop and hook connection for the closure flap.

3 Claims, 2 Drawing Sheets

68
74

62
32B
16A
38B
4
4
52
54
50
48
28
62
52
32A
38A
16A
26
50
30
62
48
70
40
42
42
16B
32A,B
44

42
40
42
36
34
36A
56
32A,B
58
38A,B
34A

CONSTRUCTION FOR EXERCISE WEIGHT COMPARTMENTS

The present invention relates generally to improvements in the construction of exercise devices worn as a wrap in encircling relation about a limb, such as a wrist or ankle, or as a belt about a user's waist, in the use of which a selected number of bar weights are inserted into cooperating compartments to determine the resistance weight of the exercise routine, and wherein the improvements more particularly are embodied in the bar weight-receiving compartments to obviate, during exercising, the inadvertent dislodgment of a bar weight therefrom.

BACKGROUND OF THE INVENTION

Field of the Invention

In my prior patents, U.S. Pat. No. 3,924,851 for "Wrist Exercise Device" issued on Dec. 9, 1975 and U.S. Pat. No. 4,997,183 for "Ankle Exercise Device" issued on Mar. 5, 1991, each of the provided number of compartments are shaped and sized to receive in projected relation therein a similar number of bar weights or, at the user's option, less than the total is used to correspondingly lessen the effort required in carrying out the exercise routine. To prevent inadvertent dislodgment during exercising of any positioned bar weight, use is made of a flap of a widthwise dimension of an extent so as to serve as a closure for all compartment openings to preserve the number-selection option of bar weights, and the positioning of a bar weight in a second-encountered compartment, or in a fourth-encountered compartment, or whatever is the user's preference.

In practice, the closure flap attachment over an empty compartment is not as secure as that over a weight-filled compartment particularly if the empty compartment is in an interposed position between two weight-filled compartments, the latter tending to hold the flap taut in its span between attachments to the weight-filled compartments and thus, in effect, the taut flap length position is in a clearance position or only nominally in-contact relation with underlying cooperating attachment hook and loop or similar connecting means of the exercise device.

SUMMARY OF THE INVENTION

Broadly, it is an object of the present invention to overcome the foregoing and other shortcomings of the prior art.

More particularly, it is an object to use to advantage the elastomeric construction material of the exercise device and of which the compartments correspondingly are embodied to hold the bar weights in place on a compartment-by-compartment basis and whether empty of, or housing a bar weight, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figures 1, 2, 4, 5, 6, 7:
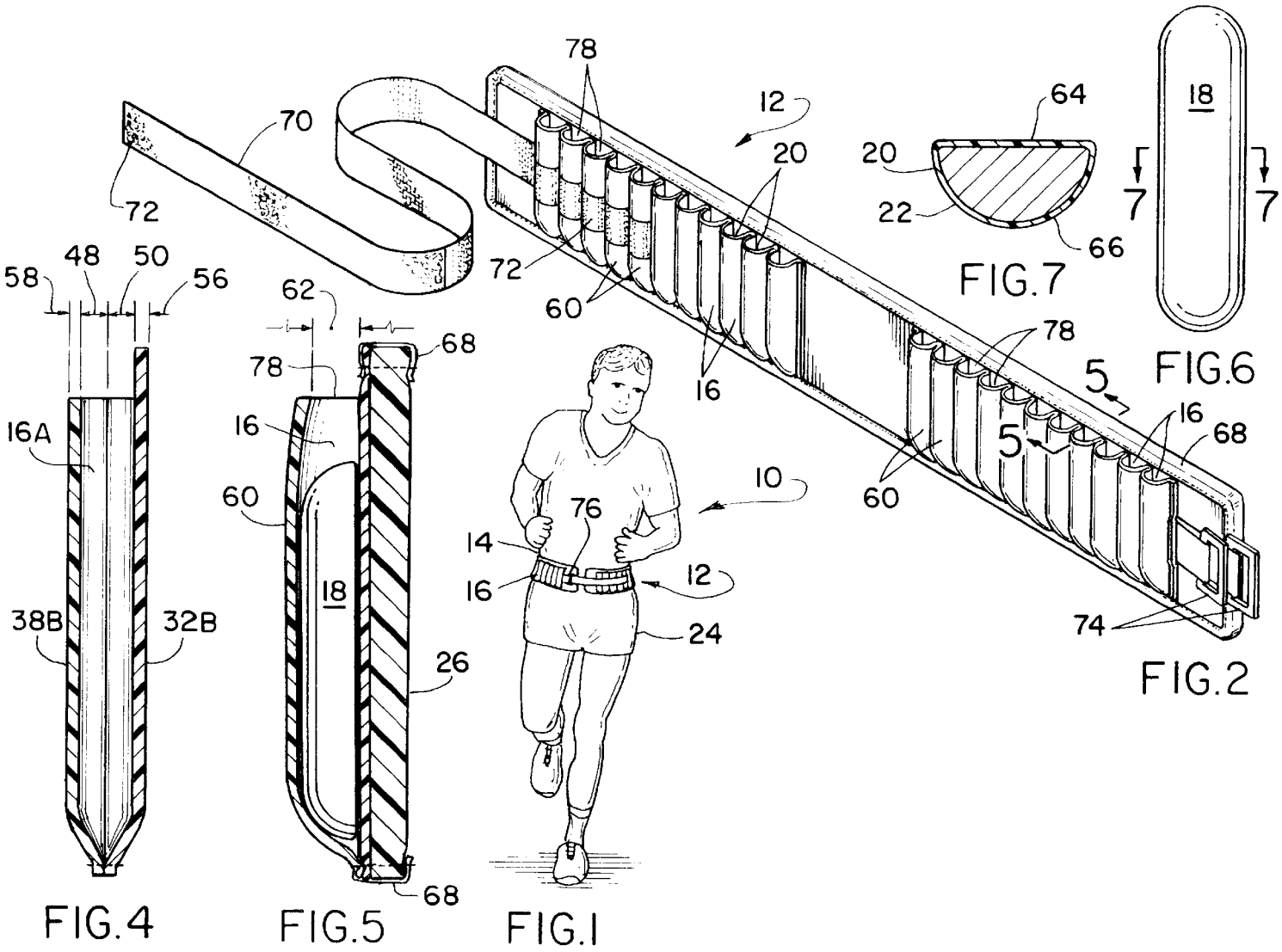
FIG. 1 is a perspective view of an exercise device having the within inventive weight-receiving compartments shown in a typical end use.
FIG. 2 is an isolated perspective view of the exercise device shown in FIG. 1.
FIG. 4 is a view in cross section as taken along line 4—4 of FIG. 3.
FIG. 5 is a view in cross section as taken along line 5—5 of FIG. 2.
FIG. 6 is an isolated front view of an exercise weight used in the weight-receiving compartments hereof.
FIG. 7 is a view in cross section of the weight of FIG. 6 as taken along line 6—6 of FIG. 6.

Exercise devices worn in encircling relation about a selected limb or location on an exercising individual, such as the illustrated jogger 10 using a belt 12 about his waist 14 are already in use for their attendant fitness benefits and are well known as exemplified by my prior U.S. Pat. No. 3,924,851 used on a wrist and U.S. Pat. No. 4,997,183 used on an ankle, the ankle to mention but a few. These exercise devices, whether used as a belt 12 or as a wrist or an ankle wrap (not shown) have in common a provision for weight-receiving compartments, individually and collectively designated 16, into which a select number of bar-like weights, such as weight 18, are positioned, typically with one weight 18 per compartment 16, so that the total number of weights 18 used establishes the weight involved in the exercise routine. It should be apparent that during the exercise routine each weight 18 must be held in place in a cooperating compartment 16 and typically this is achieved using a closure flap over the insert opening into a compartment with a previously positioned weight.

Underlying the present invention is the recognition that a preferred construction material for these exercise devices, such as belt 12 is neoprene, or a synthetic rubber, which stretched in one direction exhibits an urgency in an opposite direction to return to its unstretched condition and that these noted aspects of neoprene can be used to advantage to hold the exercise weights 18 firmly in position within the compartments 16. Also, the compartments 16 are embodied with a desired semi-circular, rather than a circular shape, individually and collectively designated 20, as best shown in FIG. 2. Semi-circular shape 20 matches the semi-circular shape designated 22 of the weight 18 which contributes to greater comfort to the user 24 over the current practice of using a circular weight in a circular compartment and which has a rear rounded portion of the weight pressing into a flat body area of the user.

To the above end, belt 12 is constructed using a first rectangular panel 26 of neoprene construction material in a preferred thickness of at least two inches and, in a belt embodiment, in a preferred length 28 of 36 inches and a preferred width 30 of 4 inches. Cooperating with panel 26 is a pair of second neoprene panels 32A and 32B, each of a length 34 of eleven inches and a width 36 of four inches, and also a third neoprene panel 38A, 38B of a size and shape matching that of the second panels 32A, 3B. It is to be noted that the combined thickness of the second and third panels 32A, 32B and 38A, 38B is selected to be less than the thickness of the first panel 26, the significance of which will soon be apparent.

Figures 3, 8, 9:
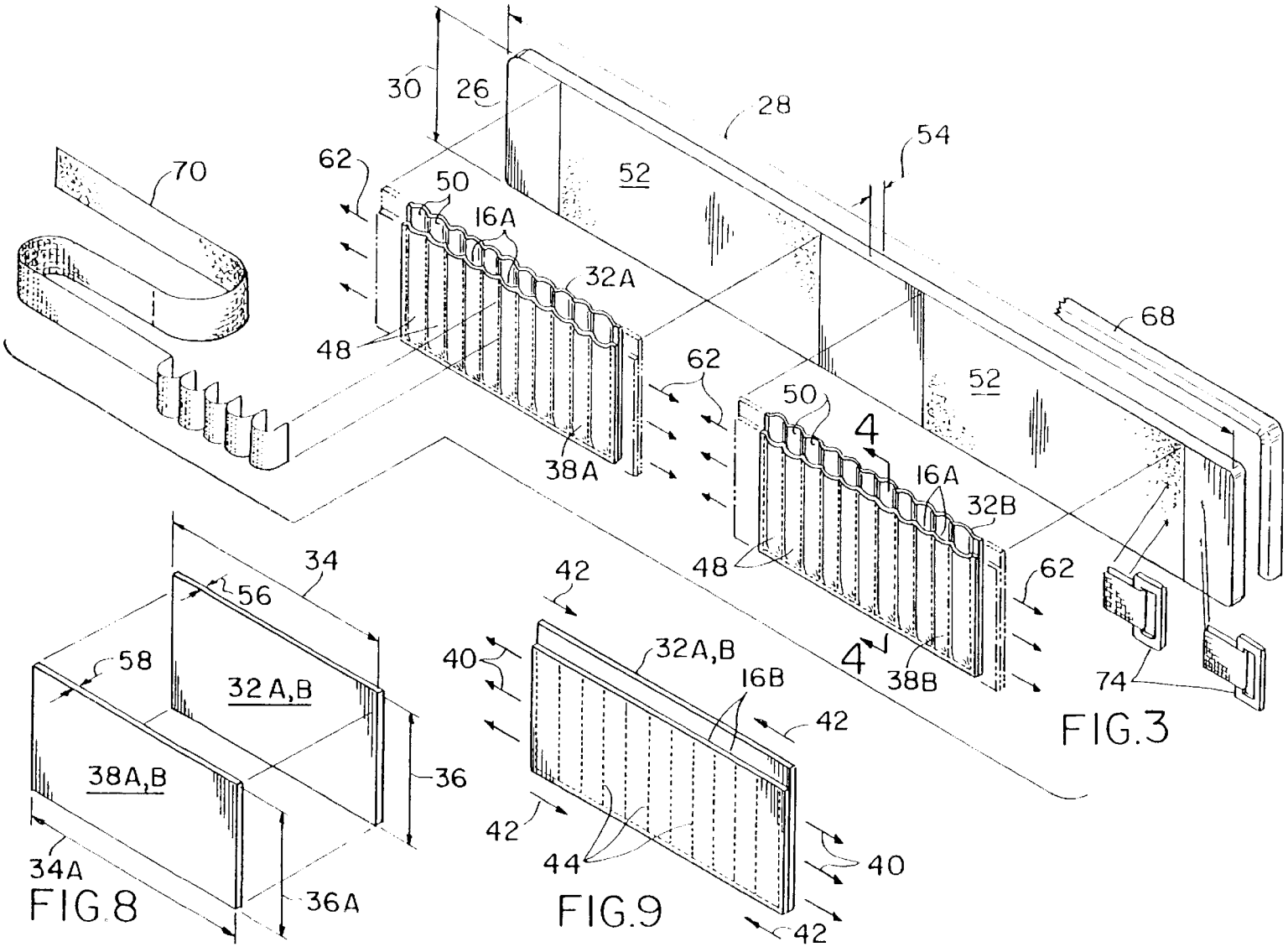
FIG. 3 is an exploded perspective view of the exercise device of FIG. 2.
FIG. 8 is a perspective view of a preliminary operation to form pockets.
FIG. 9 is a similar view showing parts assembled ready for use as shown in FIG. 3.

In the construction of the within inventive weight receiving compartment 16, a first step contemplates that each left side and right side panels 32A, B and 38A, B be placed in overlapping condition and adhesively secured to each other and stretched longitudinally, as noted by arrow 40 so as to induce an urgency 42 in an opposite direction. Next, while stretched, the sets of panels 32A, B and 38A, B are stitched together by parallel spaced apart seams 44 and the thusly stitched panels 32A, B and 38A, B are released. In their unstretched condition, the spaced apart seams 44 will be urged into closing movement by the urgency of the neoprene construction material thus producing work-in-process compartments 16A in a circular configuration, wherein a semi-circular shape 48 protrudes forwardly and a semi-circular shape 50 protrudes rearwardly, as is best understood from FIG. 3.

Next, the assembly of the second and third panels 32A, B and 38A, B with the circular shaped compartments 16A are again stretched lengthwise which flattens their manifested circular compartments 16A in a corresponding flat configuration 16B. In their flat configurated compartment condition, the panels 32A, B and 38A, B are firmly adhesively secured, as at 52, to the front surface of the first panel 26 which first panel 26 because of its greater thickness 54 than the thickness 56, 58 of the panels 32A, B and 38A, B has been found in practice to hold the three panel construction 26, 32A, B, and 38A, B against contraction lengthwise when the panel assembly 26, 32A, B and 38A, B is released. However, the flat front surface 60 of each compartment has a degree of stretch movement 62 provided by its neoprene construction material so as to be aptly characterized as having a semi-circular shape in use, although attaining said semi-circular shape starting from flat contact against an underlying back of each compartment.

The weight 18 is provided with a matching semi-circular shape 20 provided by a flat back compartment 64 and a semi-circular shaped front, 66. It should be noted that the urgency in the compartment front surface 60 is effective to hold the positioned weight 18 in place within the compartment 16.

Although the construction of the within inventive exercise device weight-receiving compartment 16 should be readily understood from the preceding description, for completeness sake it is noted that piping 68 is appropriately secured about the edge of the panel assembly to provide a finished appearance thereto, and that to hold the device in place on the user 10 there is provided a strap 70 with a hook and loop patch 72 and a buckle 74, both appropriately attached, as by stitching, by adhesive or otherwise, to extend in opposite directions from the belt 12 and interengage each other, as at 76. It is also noted that optionally there may be provided a rectangular flap (not shown) extending the length of the compartments 16 and of a nominal width of approximately one inch connected to extend in covering relation over the compartment openings 78 again more to providing a desirable finished appearance to the belt 12 than to significantly maintain the weights 18 in place in their cooperating weight-receiving compartments 16.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

In particular, there is no limitation intended to any size of the weight bars 18 since it is known practice to select bars 18 from a range of sizes to provide a corresponding range from 1, 2 and heavier pounds for an exercising routine.

What is claimed is:

1. A method of constructing an exercise article of manufacture having a select number of weight-receiving compartments therein and consisting of an assemblage of panels of stretchable neoprene construction material, said construction method comprising the steps of selecting a rectangular first neoprene panel having opposite flat inwardly and outwardly facing surfaces, selecting a cooperating pair of rectangular second and third neoprene panels, placing said second and third neoprene panels in overlapping relation, stretching slightly said overlapping second and third neoprene panels to cause an urgency therein in an opposite direction, stitching together at uniform spaced apart locations and in parallel relation to each other said second and third panels while maintaining said directional urgency in said neoprene construction material thereof, releasing to a non-stretched condition said stitched together second and third panels so as to cause said urgency to urge said parallel spaced apart stitching in closing movement upon each other, configurating in said non-stretched condition of said stitched together overlapping second and third panels an inwardly directed semi-circular compartment wall between each adjacent stitching location on said second panel and an outwardly directed semi-circular compartment wall between each adjacent stitching location on said third panel, bounding a circular shaped weight-receiving compartment out of each said facing semi-circular shaped compartment walls, closing a bottom of each said weight-receiving compartment, stretching said stitched together second and third panels so as to cause said circular shaped weight-receiving compartment to close into a flat configuration, attaching said second and third panels with said closed weight-receiving compartments to said flat outwardly facing surface of said first panel, positioning said inwardly facing surface of said first panel in contact against a user, and inserting a select number of weights in a cooperating weight-receiving compartment, whereby said combined thicknesses of said first and second panels contribute to maintaining a flat configuration in a back of each said weight-receiving compartment and said diminished thickness of said third panel results in an assumed semi-circular shape in a front of each said weight-receiving compartment to thereby hold in place each weight inserted into a said weight-receiving compartment.

2. In combination with a weight-receiving compartment as claimed in claim 1, a weight of a bar configuration having a back and a front, said back being flat and said front being semi-circular in shape.

3. A method of constructing an exercise article of manufacture having a select number of weight-receiving compartments therein and consisting of an assemblage of panels of stretchable neoprene construction material, said construction method comprising the steps of selecting a rectangular first neoprene panel of at least two inches thick having opposite flat inwardly and outwardly facing surfaces, selecting a cooperating pair of rectangular second and third neoprene panels each of a lesser thickness than said two inches, placing said second and third neoprene panels in overlapping relation, stretching slightly said overlapping second and third neoprene panels to cause an urgency therein in an opposite direction, stitching together at uniform spaced apart locations and in parallel relation to each other said second and third panels while maintaining said directional urgency in said neoprene construction material thereof, releasing to a non-stretched condition said stitched together second and third panels so as to cause said urgency to urge said parallel spaced apart stitching in closing movement upon each other, configurating in said non-stretched condition of said stitched together overlapping second and third panels an inwardly directed semi-circular compartment wall between each adjacent stitching location on said second panel and an outwardly directed semi-circular compartment wall between each adjacent stitching location on said third panel, bounding a circular shaped weight-receiving compartment out of each said facing semi-circular shaped compartment walls, closing a bottom of each said weight-receiving compartment, stretching said stitched together second and third panels so as to cause said circular shaped weight-receiving compartment to close into a flat configuration, adhesively attaching said second and third panels with said closed weight-receiving compartments to said flat outwardly facing surface of said first panel, positioning said inwardly facing surface of said first panel in contact against a user, and inserting a select number of weights each in semi-circular shape in a cooperating weight-receiving compartment, whereby said combined thicknesses of said first and second panels contribute to maintaining a flat configuration in a back of each said weight-receiving compartment and said diminished thickness of said third panel results in an assumed semi-circular shape in a front of each said weight-receiving compartment to thereby hold in place each weight inserted into a said weight-receiving compartment.

* * * * *